US006520072B2

(12) United States Patent
Chedru et al.

(10) Patent No.: US 6,520,072 B2
(45) Date of Patent: Feb. 18, 2003

(54) WASTE COMPACTING METHOD AND MACHINE

(75) Inventors: Antoine-Marie Chedru, Fecamp (FR); Eric Marcel Denis Morisse, Fecamp (FR)

(73) Assignee: Valdec, Fecamp (FR)

( * ) Notice: Subject to any disclaimer, the term of this patent is extended or adjusted under 35 U.S.C. 154(b) by 48 days.

(21) Appl. No.: 09/737,862

(22) Filed: Dec. 18, 2000

(65) Prior Publication Data

US 2001/0003952 A1 Jun. 21, 2001

(30) Foreign Application Priority Data

Dec. 18, 1999 (FR) ..... 99 16833

(51) Int. Cl.[7] ..... B30B 13/00; B30B 3/02; B30B 15/16

(52) U.S. Cl. ..... 100/35; 100/210; 100/52; 100/99; 100/256; 100/68; 100/215

(58) Field of Search ..... 100/210, 35, 52, 100/99, 256, 68, 215

(56) References Cited

U.S. PATENT DOCUMENTS

| | | | | |
|---|---|---|---|---|
| 3,720,052 A | * | 3/1973 | Anderson et al. | 100/100 |
| 4,426,925 A | * | 1/1984 | Bergmann | 100/210 |
| 4,524,685 A | | 6/1985 | Bergmann | 100/210 |
| 4,735,136 A | * | 4/1988 | Lee et al. | 100/229 A |
| 4,870,898 A | * | 10/1989 | Spencer | 100/215 |
| 5,492,056 A | | 2/1996 | Hansen | 100/210 |
| 5,579,688 A | | 12/1996 | Byrne et al. | 100/210 |

FOREIGN PATENT DOCUMENTS

| | | | |
|---|---|---|---|
| DE | 3342187 | | 5/1985 |
| DE | 3718359 | | 12/1988 |
| DE | 3903642 | * | 8/1990 |
| FR | 2769900 | | 4/1999 |
| WO | 8809757 | * | 12/1988 |
| WO | 9321007 | | 10/1993 |
| WO | 9525632 | | 9/1995 |
| WO | 9608365 | * | 3/1996 |

* cited by examiner

*Primary Examiner*—Allen Ostrager
*Assistant Examiner*—Jimmy T Nguyen
(74) *Attorney, Agent, or Firm*—Millen, White, Zelano & Branigan, P.C.

(57) ABSTRACT

This invention concerns a method for compacting waste in a machine including an cylindrical, open-top tank (2–4) and a compacting head (15, 16), wherein a horizontal toothed roller (16) is arranged in said tank (2–4) and bears on said waste under its own weight, and said roller (16) can be rotated around the central vertical axis of said tank by the action of a driving member (15). The method is characterized in that a quantity indicative of the force exerted by said driving member (15) is monitored, and in that, when said quantity exceeds a predetermined threshold, an unclogging operation is performed by (a) first raising said roller (16) up to a predetermined height and (b) then releasing said roller (16) thus causing it to lower back onto the waste, while being rotatively driven in the opposite direction. In the case of a machine wherein said roller (16) is simultaneously rotatively driven around its own axis, the direction of such rotation also preferably is reversed after said roller (16) has been raised.

17 Claims, 5 Drawing Sheets

WASTE COMPACTING METHOD AND MACHINE

The present invention relates to waste compacting in particular for disposable packaging, made of cardboard or similar materials, based on organic resins for instance, (and plastics in general), in a machine able of shredding and compressing such waste and thus substantially reducing the volume thereof. Such compacted waste is generally gathered in a movable and exchangeable receptacle of the machine, for instance a transport bag.

BACKGROUND OF THE INVENTION

Within this frame, the object of the invention essentially resides in a compacting method, which allows eliminating any clogging risk that would cause a machine failure during a compacting operation, as well as in a machine including proper means for implementing the various steps of such method.

A machine presently applied for compacting cardboard and other disposable packaging is described in French Patent Application 97 12 967, filed Oct. 16, 1997. It essentially includes a cylindrical, open-top waste reception tank, and a compacting head comprising a toothed roller that is arranged in said tank and bears on said waste under its own weight. The toothed roller is subject to two rotation motions: a first rotation wherein the top of the compacting head is pivoted around the central tank axis, which is vertically oriented in normal operation, and a second rotation wherein the roller is rotated around its own longitudinal axis. In usual practice, this roller is preferably cylindrically shaped and generally oriented perpendicular to the tank axis, its own axis being consequently horizontal in normal operation.

Some of these machines, in particular those that operate on a continuous basis, provide for an inversion of the roller rotation direction around the tank axis such that, when the waste causes a clogging and consequently blocks the forward motion of the roller, the latter will revert in the opposite direction and, after a complete revolution around the tank axis, will attack the clogging from the other side therof. Such inversion of the roller rotation direction is described in U.S. Pat. No. 5,579,688. It however turns out that this solution is not very fast since it suggets many back-and-forth motions of the roller around the tank axis before the destruction of this clogging has been achieved.

SUMMARY OF THE INVENTION

The object of the invention is to solve the problems which sometimes appear when using machines of this type, in particular when a machine is designed for continuous operation such that waste is thrown or otherwise introduced into the tank in variable and continuous quantities, while the compacting head is rotating. Since the waste supply into the tank is irregular, some local clogging phenomena may happen and impair proper compacting and/or shredding of the waste.

The object of the invention consequently is to provide a method that eliminates clogging in order to obtain a regular waste compacting, and a reduced volume inside a bag or other receptacle placed inside the tank In a general manner, the method of the invention essentially includes the following steps:

a quantity indicative of the force exerted by said driving member is monitored, and when said quantity exceeds a predetermined threshold, an unclogging operation is performed by a) first raising said roller (16) up to a predetermined height, and b) then releasing said roller (16) thus causing it to lower back onto the waste while being rotatively driven in the opposite direction.

Inasmuch as the compacting head continues rotating inside the tank while being raised, it can easily pass on top of a clogging point and simultaneously eliminate it. In such manner, the toothed roller first attacks and spreads the clogging zone, on one first side of this zone, while being raised. After having passed over the zone top if the returns onto the other side while rotating in the opposite direction around its own axis, so that the clogging normally is suppressed. Said unclogging operation is repeated if said effort or moment still exceeds said threshold after this motion in the opposite direction.

In this way, the compacting head directly attacks and destroys the clogging on the very zone it occupies, without requiring a complete revolution around the tank axis.

In a preferred case the roller that compacts the waste by pressing it under the compacting head weight, while this roller rotates around the tank axis, also performs a shredding of the waste material, which is particularly efficient since the roller is toothed and simultaneously rotating around its own axis. In this case, the invention may provide for an inversion of the roller rotation direction around its own axis, after the roller has been raised with the whole compacting head and the head rotation direction has been reversed. This improves the effect of the roller on the clogging, eases the shredding and consequently improves the compacting.

Advantageously, a single motor controls both rotation motions; in normal operation, the motor rotation direction is periodically reversed and the period of time between two successive normal inversions is longer than the unclogging operation duration. According to a particular embodiment of the invention which implements this feature, the unclogging operation will last 5 seconds at the most whereas the reversion period in a normal operation will, at least, last 20 seconds.

According to another aspect, the invention includes a machine for implementing preferably in an automatic manner the various steps of the method.

Such a machine advantageously includes means for detecting the force exerted by said driving member, means for stopping of said driving member as well as its operation in one rotation direction or its operation in the other rotation direction, and means for raising the compacting head, said detection means automatically acting upon said control means and said raising means.

This machine also advantageously includes means for detecting the height of the compacting head and providing a full-tank signal when said height exceeds a predetermined threshold: the full-tank signal triggers a delay time having a duration longer than the duration of said unclogging operation; and the machine is stopped if, and only if, the height of the compacting head continuously exceeds said full-tank threshold during said delay time. This avoids the risk of an unexpected machine standstill when the raising head height temporarily exceeds the full-tank level while the head is raised during an unclogging operation.

According to an advantageous feature of the invention, such raising means may include a pressure cylinder and the raising height is determined by the actuation duration of said cylinder.

According to another feature, favorably combined with the preceding one, the driving member may include a hydraulic motor, with said motor and said pressure cylinder being supplied through a same circuit from a motor-driven pump connected with a vessel for the hydraulic fluid.

The force detecting means preferably then includes a pressure detector, having a threshold, for measuring the supply pressure at the entrance of said motor.

The pressure cylinder can be arranged in a vertical housing arranged in the vicinity of said tank, with the compacting head bearing a shielding sheet that can be moved in front of said housing to prevent any waste penetration into said housing.

A shielding skirt can be attached to said compacting head so as to be tangentially movable with respect to the receptacle walls, to insure that any waste tending to escape from the tank during the shredding and compacting operations falls back into this tank. Such a skirt preferably is connected, or integral, with the compacting head: it as a result is completely disengaged from the tank when said compacting head is in its uppermost position so that the skirt does not impair the extraction of the receptacle, usually a flexible bag, out of the tank.

The machine may include detection means located at the same level as said compacting head and consisting of a cam integral with the compacting head and cooperating with a detector.

The machine of the present invention preferably is provided with several supply hoppers located around the cylindrical tank, which causes a uniform distribution of the waste after it has been introduced into the tank. Any clogging thus is of a lesser size and can be faster destroyed.

BRIEF DESCRIPTION OF THE DRAWINGS

All of the foregoing operations or principles and advantages of the present invention will be more fully appreciated upon consideration of the following detailed description, with reference to the appended drawings, of which.

DETAILED DESCRIPTION OF THE INVENTION

Figure 1:
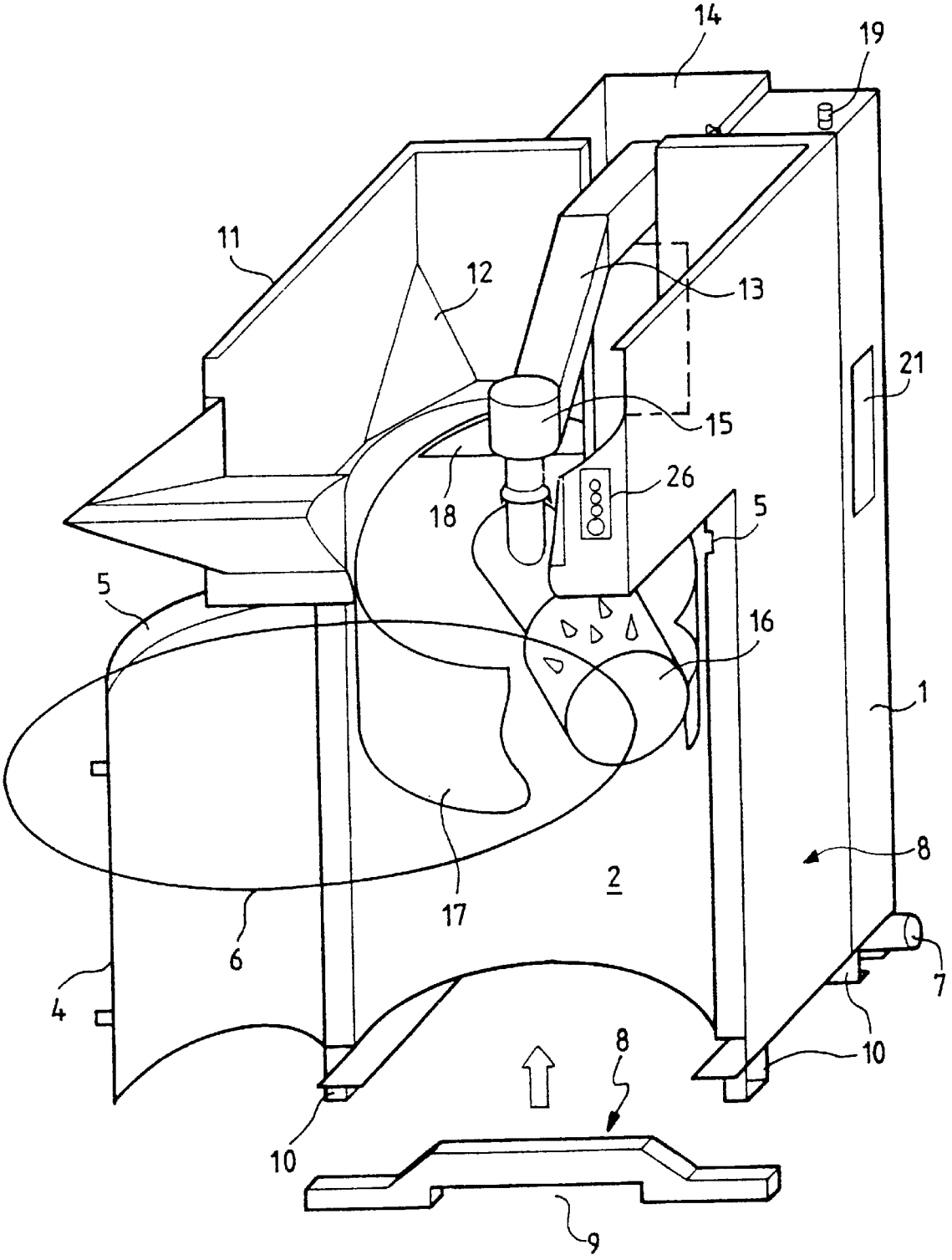
FIG. 1 is an exploded perspective view of a waste compacting machine built according to a particular embodiment of the invention.

The machine represented in FIG. 1 is designed for compacting waste consisting of reusable materials, which will be gathered in a generally flexible bag made of plastic material, which is placed inside the machine for gathering the compacted material under the so-called bale shape.

The machine of the invention more particularly is designed for handling cardboard pack aging, but it also can operate on light packaging consisting of plastic materials, bulk paper, wood and thin metal sheets, and more generally compressible material, that can be reduced in volume by shredding and pressing.

The machine essentially includes a frame 1 with a bottom having legs 10 so as to have a palette type structure which allows carrying the frame 1 with a fork lift truck, for instance of the palette truck type.

The frame 1 includes a cylindrical tank 2 which is limited by a fixed, half-cylindrical part 3 and two doors 4, respectively shaped as quarters of a circle, which close on the front of the frame 1 (only one door is represented for clarity purposes).

Figure 6:
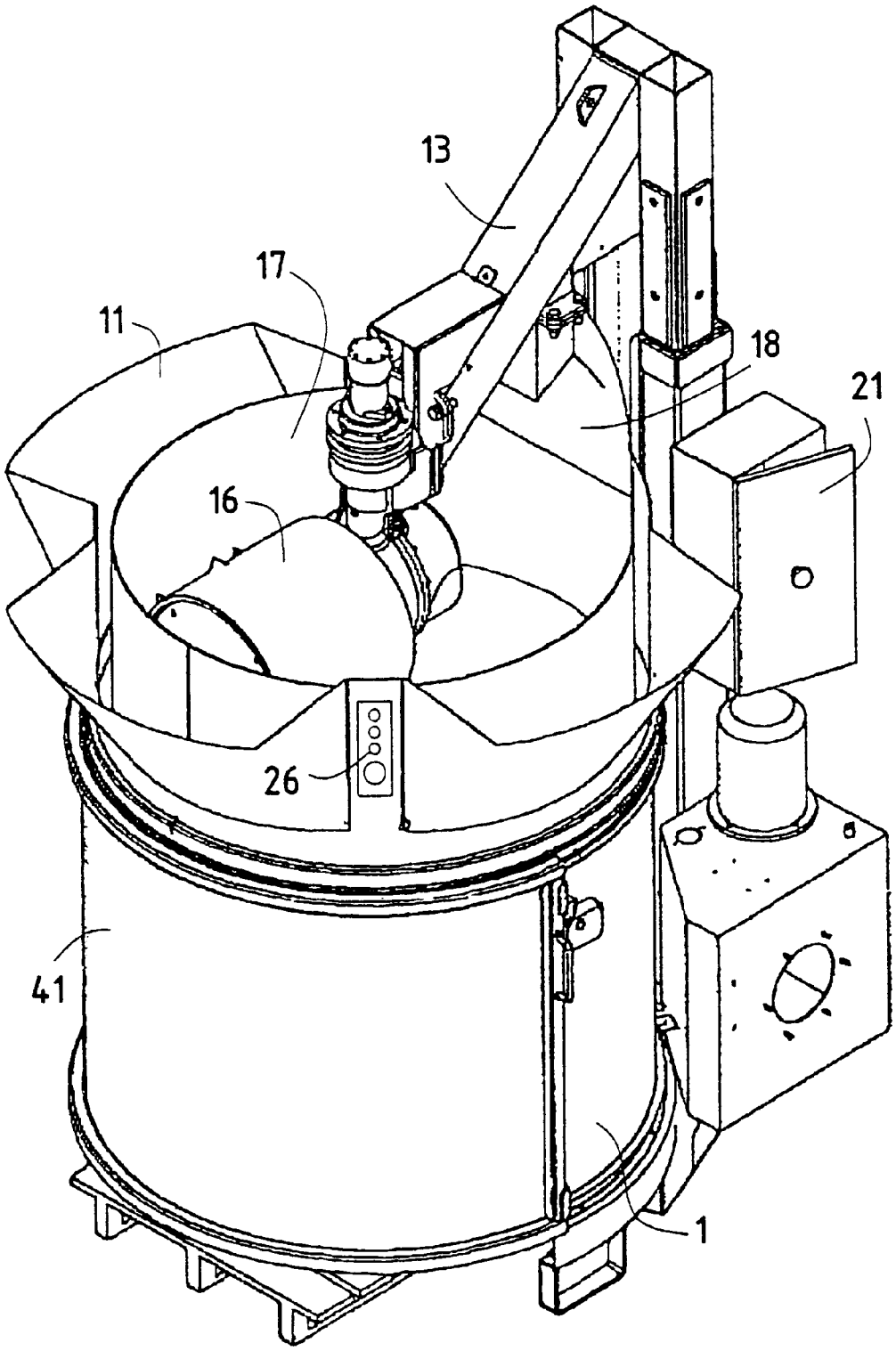
FIG. 6 is a persepctive view of a waste compacting machine built in accordance with a preferred embodiment of the invention.

According to a preferred embodiment, the machine also can be provided with several supply hoppers 11, distributed around the cylindrical tank as shown in FIG. 6, which allows introducing the waste into the tank in a more extended manner and thus promotes a more uniform distribution. Since the waste has been more uniformly introduced, any clogging it sometimes can cause is of a lesser size, which will promote a faster execution of the unclogging operation. The hoppers advantageously can be tiltable, which allows reducing the overall dimensions of the machine, e.g. for transporting purposes.

An horizontal groove 5 is formed in the wall top part of the tank 2, i.e. in the fixed half tank 3 and in the doors 4, to receive a bow 6 for attaching a deformable flexible plastic bag inside the tank.

At its bottom rear part, the frame 1 includes two rollers 7, of which only is seen on FIG. 1. A bar 8, that can be placed under the bottom of the frame 1, can be fixed on the front part of this frame, ahead of the front legs 10. This bar 8 includes a central aperture 9, adapted for the fork of a palette truck.

The top of the tank 2 is open and a hopper 11 is arranged above it for supplying the used packaging cardboard. The general shape of the hopper is rectangular and it has, at each lower rear corner, a slanted triangular plate 12 to avoid any material accumulation in these corners.

According to an alternative embodiment of the invention, both doors respectively shaped as quarters of a circle can, as shown in FIG. 1, be replaced by a single sliding door 41 that will, when open allow avoiding any traffic impediment around the machine and preferably is provided with a magnetic safety device to avoid any finger pinching.

Figure 2:
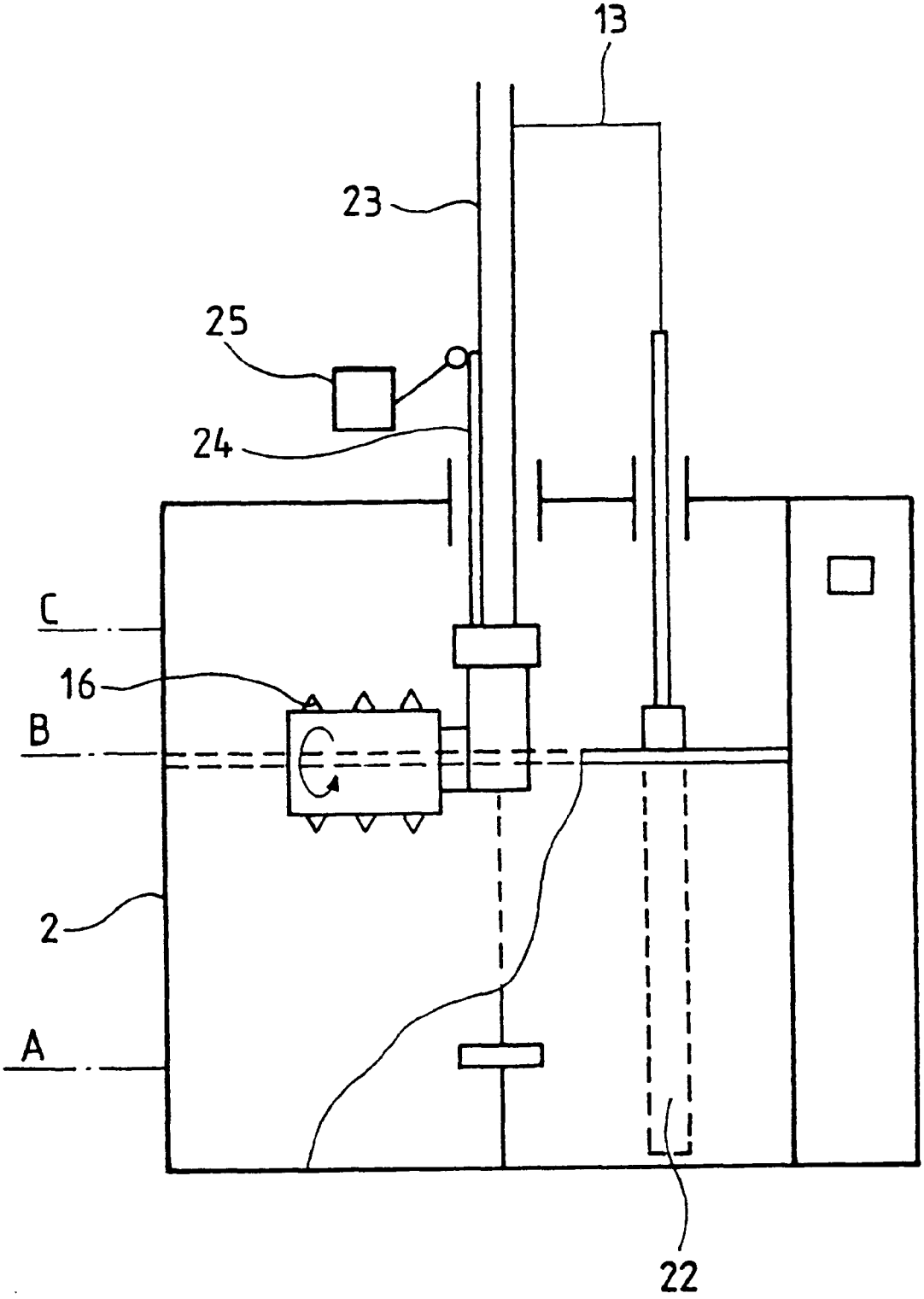
FIG. 2 is a schematic cross-section view illustrating the method of the invention as performed by means of such a machine.

The compacting device includes a substantially horizontal support arm 13; one of its ends can be vertically translated by the action of a cylinder 22 inside a vertical housing 14 arranged in the vicinity of the tank 2, as seen in FIG. 2. This simple effect type cylinder is located inside the housing 14. It only exerts a forced motion in the raising direction, to raise said arm 13; the arm will freely lower, under its own weight, when the cylinder is connected to the exhaust line.

At its other end, the arm 13 bears a hydraulic motor 15, which imparts a double rotation motion to the horizontally arranged toothed roller 16 inside the tank 2. The double rotation motion is as follows: on the one hand, the toothed roller 16 turns around its own horizontal longitudinal axis; on the other hand, it rotates in a horizontal plane around the central vertical axis of the tank 2. The toothed roller 16, which only extends on one side of the central tank axis, consequently turns inside the tank 2 while rotating around its own axis.

The double rotation motion of the toothed roller is driven by a single motor, namely the hydraulic motor 15, by means of a gearbox transmission set as already described in the French Patent 97 12 967.

Mechanical coupling means rotatable between the central vertical tank axis and the support arm 13, advantageously are provided to drive the toothed roller for both of its rotation motions, around its own axis and around the tank axis, with such means according to a preferred embodiment consisting of a pair of gears respectively attached to the vertical tank axis and the support arm 13.

A cylindrically shaped shielding skirt 17, of a diameter slightly smaller than the diameter of the tank 2, is attached on the support arm 15 so as to move vertically with the latter while sliding inside the tank 2. This in particular avoids that the toothed roller, by rotating, may throw shredded material waste out of the receptacle bag footprint, and insures that such waste will fall back into the bag, to be compacted by the weight of the movable set.

A slanted protection sheet 18 also is attached to the arm 13. It is arranged in front of the vertical housing 14 and slanted towards the inside of the tank. Its object is to avoid any waste intrusion into the housing 14.

FIG. 1 also allows ascertaining that various equipment are present on the machine frame 1, such as a visual indicator 19 which, when triggered by a full-tank detector, will light up to signal that the bag is full and an intervention window 21 and a control console 26.

FIG. 2 schematically shows the functional connections of the cylinder 22 for raising the arm 13, which also vertically translates the toothed roller 16. The roller is supported at the end of a shaft 23, coaxial with the tank 2 and supported by the arm 13. This shaft 23 has a cam surface 24 that cooperates with a position detector 25, attached on the frame 1. When the compacting head reaches or exceeds the position B which corresponds to the so called full-tank status, or bale-end status, the cam activates the detector 25 that then, among others, will automatically cause the visual indicator 19 to light up.

Figure 3:
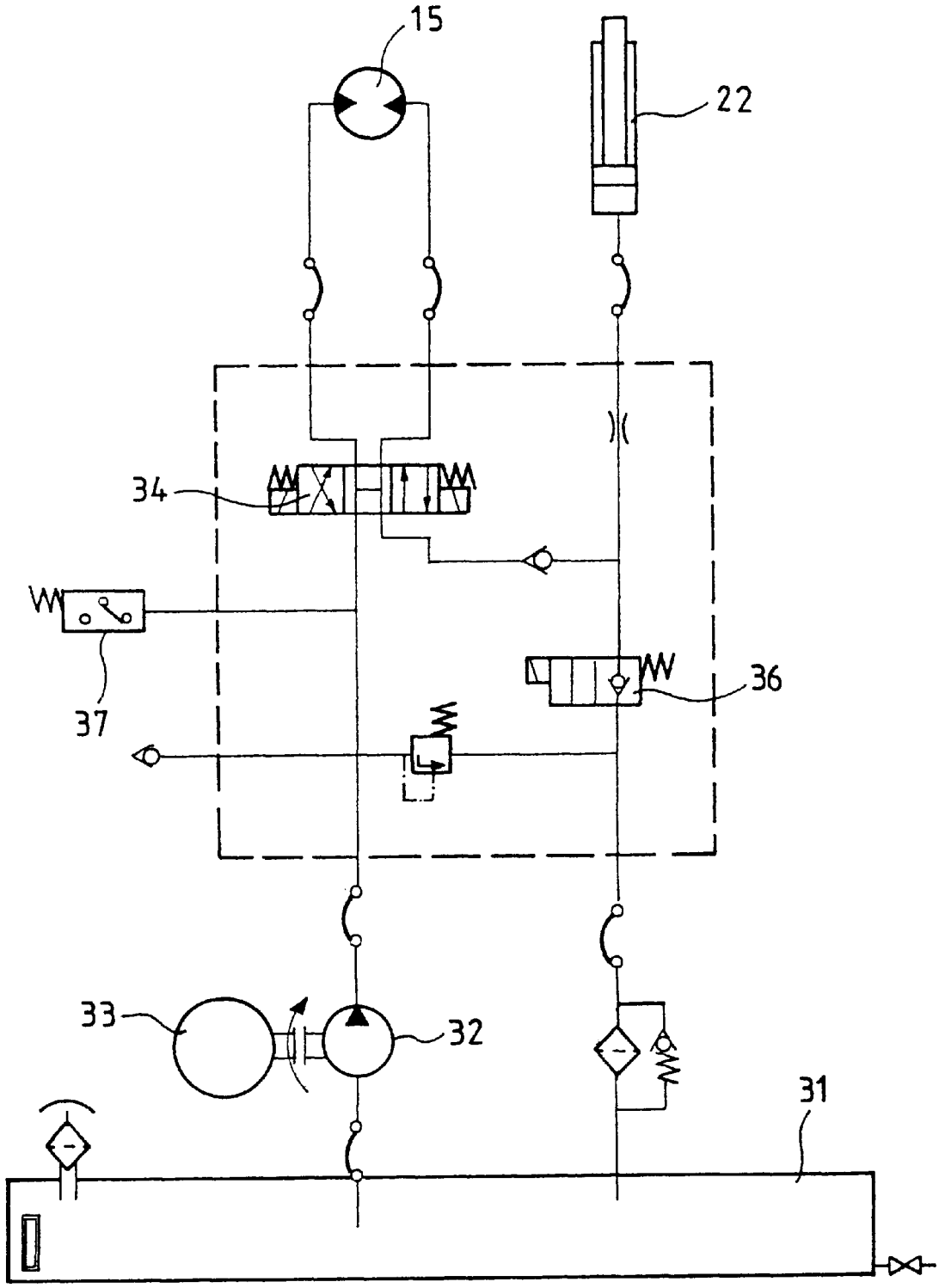
FIG. 3 is a diagram of the hydraulic circuit of the particular considered machine.

FIG. 3 is a schematic of the mechanical driving devices inside the compacting head. The system is of a hydraulic type. It includes a pressure fluid vessel 31, connected with the pump 32 of a motor-driven pump driven by an electric motor 33.

The driving motor 15 of the arm 13, since it is a hydraulic motor, is supplied with pressurized fluid from the pump 32, by means of a three-position inverter collector 34 that allows either a direct or a reverse supply of the motor 15, so as to obtain both rotating directions, or else a direct connection with both input and output lines of the motor, in the standstill position of the motor 15.

The hydraulic cylinder 22 which as already mentioned is a single effect cylinder also is supplied with pressurized fluid from the pump 32, through a two-position distributor 36 that controls the connection of the cylinder, either with the high pressure source, or with the exhaust line and thus with the vessel 31, which will cause the compacting head to lower under its own weight.

Figure 5:
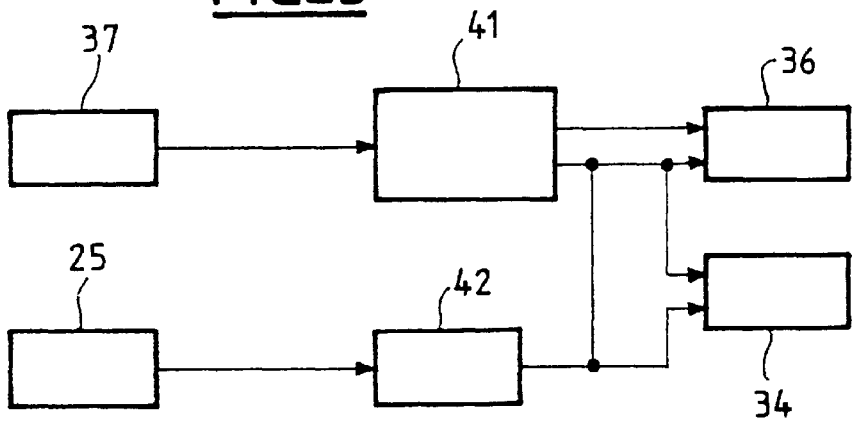
FIG. 5 is a synoptic diagram of the main electric control circuits of the machine members that will operate for performing the method of the invention.

The figure also shows a pressure detector 37 for detecting the input pressure for the motor 15 and providing a signal when such pressure exceeds a predetermined threshold FIG. 5 is a synoptic view of the machine controller. It shows that the threshold pressure detector 37 thus provides a threshold-exceeded signal which is forwarded to a logic circuit inside the control 41, the output of which is connected to the distributor 36 and the distributor 34. Furthermore, the position detector 25, responsive to the high, full-tank level of the compacting head provides a threshold-exceeded signal to the delay time circuit 42, the output of which is connected to the distributor 36 and the distributor 34.

The operation of the machine described above already is clear from such description and the corresponding drawings. This operation however will be recalled hereafter to allow for a better understanding of the various operations to be performed when applying the method of the invention.

After both doors 4 have been opened, a plastic bag is placed inside the half tank 3 and hangs with its top edge outside the bow 6 which is to be engaged into the groove 5; both doors 4 are then closed while the bow is being held inside the groove 5. The bag is then kept open and hangs inside the tank 2.

During the above phase, the cylinder 22 is kept under pressure and holds the arm 13 in its uppermost position wherein the movable set consisting of the motor 15, the toothed roller 16 and the skirt 17 is entirely disengaged from the tank 2; this position is illustrated in C in FIG. 2.

When the bag has been introduced, the cylinder is connected to the exhaust line so that the arm lowers to the minimal position: i. e. A on FIG. 2, wherein the toothed roller is close to the bottom of the bag inasmuch as the latter is empty.

The machine is ready to operate to handle the waste being admitted into the tank through the supply hopper 11. To actually perform the compacting, the motor 15 is started, either by a manual control from the control console 26, or automatically by means of detection cells arranged on both sides of the hopper 11 to control the operation, that is started for a limited duration each time a particular waste lot is passing by.

The toothed roller 16 is driven by the motor 15 to rotate around its own axis while also rotating around the shaft 23. The skirt 17 acts as a shielding to make sure that all of the waste thus falls inside the bag, and the slanted plate 18 prevents any waste penetration into the housing 14, which would be detrimental for the vertical translation movements of the arm 13.

While waste is introduced, the level in the bag inside the tank will raise and the toothed roller 16 progressively will be rise while still bearing on the waste and pressing it under its own weight. Its double rotation motion also performs a shredding and a distribution of the waste. A regular compacting is altogether obtained.

If the toothed roller 16 encounters a resistance constituting a clogging while rotating inside the tank, the motor 15 needs exerting a more important effort. If a waste mass tends to aggregate and the machine can not handle it, an increase of the hydraulic pressure results as a reaction. When such a pressure reaches or exceeds a certain threshold, for instance 100 bars, the detector 25 provides the logical circuit 41 with a threshold-exceeded signal, which triggers the unclogging operation.

Figure 4:
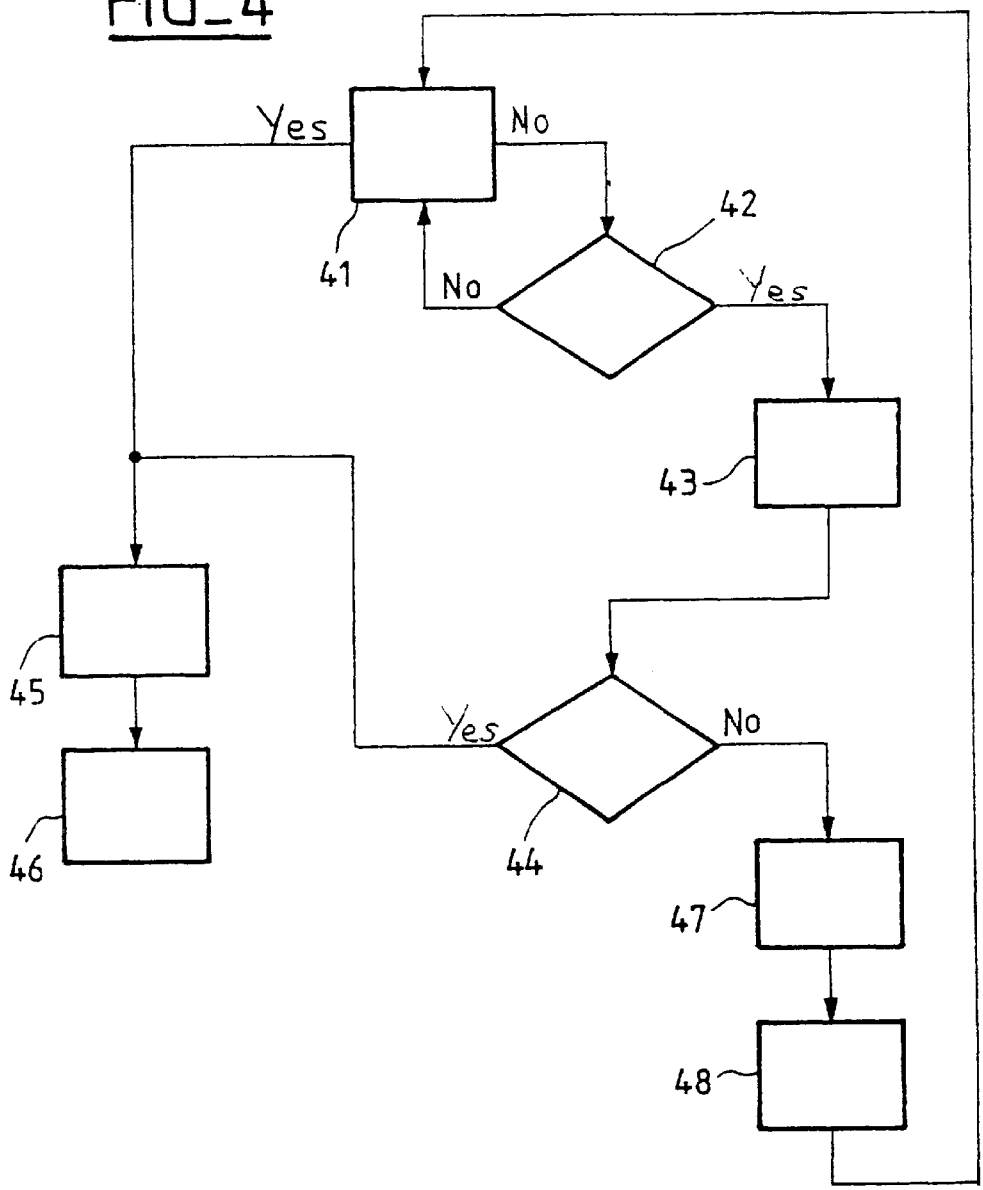
FIG. 4 is a flow chart illustrating various sequences of the method of the invention in the successive operational steps that are implied.

FIG. 4 schematically represents both the automatic controls that operate in case a clogging is detected and the controls that determine the machine standstill when the tank is full, whether or not a clogging happens at the same time.

The height of the support arm 13 namely is permanently monitored, with the cam 24 and the position detector 25, so as to detect a full-tank or bale-end status: step 41. If a position indicating such a status is detected, the cylinder 22 is powered, the motor is stopped and the movable set is raised to its uppermost position as represented by C in FIG. 2. In this position, the set is sufficiently high for the protection skirt 17 to be above the tank, which allows disengaging the full bag. Simultaneously, the visual indicator 19 lights up to signal the operator that no waste should be sent into the tank. The full bag can then be evacuated, for instance by mean of a palette truck, after both doors 4 have been opened.

In the absence of any bale-end signal, the unclogging controls are automatically determined by monitoring the motor supply pressure by means of the detector 25, step 42. As long as the threshold is not exceeded, no particular action is performed. If however this threshold is exceeded, the unclogging operation is triggered. It consists of triggering a delay time, step 43, during which the compacting head is raised up to a certain height and the motor is stopped. The compacting head can for instance be raised for 3 seconds and the motor can be stopped after 2 seconds. The motor operating period is calculated as a function of the rotation speed of the toothed roller 16 inside the tank 2 to insure that the roller, during this unclogging operation, will pass on the other side of the material aggregate that created the clogging. The motor power supply is then stopped for one second, which is enough for the roller to come to a standstill, so that it later on can be rotated in the opposite direction without any risk.

When the raising cylinder is actuated, the motor supply pressure will lower below the threshold value since some hydraulic fluid (which in practice is pressurized oil) is taken up by the cylinder, and the motor is unloaded when the roller is raised above the clogging aggregate.

When this delay time is elapsed, the method checks whether any bale-end signal is present, step 44. If such is the case, the standstill phase of the machine for unloading the compacted waste bag is triggered: the movable set is completely raised, step 45, and the motor is stopped, step 46.

If no bale-end signal is provided, the motor is energized so as to rotate in the opposite direction, which causes an inversion of its rotation direction around the tank axis, due to the above mentioned mechanical coupling, step 47, and the compacting set is lowered by connecting the cylinder 22 with its exhaust line, so that the toothed roller 16 again will move down onto the waste and compact it. The clogging status is then monitored again as indicated by the arrow 49.

The delay time and the roller raise height, which depends upon the actuation time of the cylinder 22, are controlled in such a way that the toothed roller in most cases first passes above the clogging to thus reduce it, and that it then will completely eliminate it when reverting in the opposite direction. If a clogging still is ascertained, the invention provides for another unclogging operation.

The compacting head thus will attack the clogging on one side therof while being raised, pass on the top of the clogging, in principle be lowered on the other side of the clogging and attack the latter on this other side while getting lowered, and this unclogging operation will be repeated until the clogging has been completely eliminated.

The so called full-tank or bale-end detection is performed by means of the detector 25 during step 41 in the following manner: when the height threshold B is exceeded, a delay time of a duration longer than the unclogging operation is triggered, for 10 seconds for instance. If the height has kept exceeding the threshold 5 during this delay time, a bale-end signal is provided, and then tested at step 44. This testing avoids unwanted stops in cases where the compacting set temporarily is raised higher than the position B, in order to handle a clogging when the tank only is almost full, but this set thereafter is immediately lowered again.

It should be noted that the automatic controls periodically causes the rotation direction of the motor 15 to be reversed, even in situations in which a regular supply of homogeneous waste into the machine avoids any clogging. In normal operation, the motor rotation and consequently both combined rotation motions of the toothed roller are reversed in the same manner as described above in the case of a clogging, but the compacting set is not raised when no clogging is detected. The period of time obviously is longer than the duration of the unclogging operation, 20 second for instance.

The machine of the invention accordingly insures, in all circumstances, a regular compacting to form a homogeneous, high-density bale, wherein the waste was efficiently shredded while being compressed. As described above, additional inversions are guaranteed every time a clogging appears, and raising the arm makes it easier for the toothed roller to first pass in one direction inside the zone where the material has aggregated, and then revert through this zone in the other direction, in order to eliminate the clogging. Allowing for a delay time, before a final standstill, avoids unwanted stops during an unclogging operation while the bale is still being formed and has not completely filled the bag.

In connection with the supply through the hopper 11, which can be performed manually or by a waste discharging chute, it incidentally should be noted that the described machine is built so as to be movable. In order to move the machine and have it to turn around a vertical axis, it is possible to put on the front a plate 8 shown on FIG. 1, and let a palette truck enter into the hole 9 in the bar 8, and rotate the machine by rotation on the rear rollers 7.

The invention obviously is not limited by the arrangements and embodiments specifically described above. It, on the contrary, includes any modification resulting from equivalent means. In particular, other driving members, for instance an electric motor, can be used, but the presently described embodiment offers the advantages that the delay time during the unclogging operation can very simply be obtained due to the inertia of the hydraulic motors, as a result of the duration of the cylinder action.

We claim

1. A method for compacting waste in a machine including a cylindrical open-top tank (2–4) and compacting head (15–16) wherein a horizontal toothed roller (16) is arranged in said tank (2–4) and bears on said waste, and said roller (16) can be rotated around the central vertical axis of said tank by the action of a driving member (15), wherein a quantity indicative of the force exerted by said driving member (15) is monitored, and wherein, when said quantity exceeds a predetermined threshold, an unclogging operation automatically is performed by:

a) first raising said roller (16) up to a predetermined height, and b) then releasing said roller (16) thus causing it to lower back onto the waste, while being rotatively driven in the opposite direction.

2. The method of claim 1, wherein the direction of rotation of said driving member (15) is periodically reversed in normal operation, the period of time between two successive normal inversions being longer than the unclogging operation duration.

3. The method of claim 1, wherein said machine further includes a means for detecting (24–25) the height of the compacting head (15–16) and providing a full-tank signal when said height exceeds a predetermined threshold (B), said full-tank signal triggers a delay time having a duration longer than the duration of said unclogging operation, and wherein if the height of the compacting head (15–16) continuously exceeds said full-tank threshold (B) during said delay duration time, a bale-end signal is provided to stop the machine.

4. The method of claim 2 wherein said roller (16) is simultaneously rotatively driven around its own axis and the direction of such rotation is also reversed after said roller (16) has been raised.

5. A machine for compacting waste, comprising an cylindrical open-top tank (2–4) and compacting head (15–16) with a horizontal toothed roller (16) arranged in said tank (2–4) and bearing on said waste, said roller (16) being rotative in an initial direction around the central vertical axis of said tank by the action of a driving member (15), and further comprising detecting means (37) for detecting the force exerted by said driving member, control means (34) for stopping said driving member (15), or operating it in one rotation direction, or operating it in the other rotation direction, raising means (22–36) for raising the compacting head (15–16), said detection means (37) automatically acting upon said control means (34) and said raising means (22–36), and means to command automatically an unclogging operation when said force exceeds a predetermined threshold, said unclogging operation consisting in:

a) first raising said roller (16) up to a predetermined height, and b) then releasing said roller (16) thus causing it to lower back onto the waste, while being rotatively driven in the opposite direction.

6. The machine of claim 5, wherein said raising means (22–36) include a pressure cylinder (22), the raising height is determined by the acuation duration of said cylinder (22), said driving member includes a hydraulic motor (15), and said motor (15) and said pressure cylinder (22) are supplied through a same circuit from a motor driven pump (32) connected with a vessel (31) for the hydraulic fluid.

7. The machine of claim 6, wherein said detecting means include a pressure detector (37) for measuring the supply pressure at the entrance of said motor (15) and for triggering the unclogging operation through a threshold-exceeding signal.

8. The machine of claim 7, wherein said pressure cylinder (22) is arranged in a vertical housing (14) arranged in a vinicity of said tank (2–4), and wherein said compacting head (15–16) bears a shielding sheet (18) that is movable in front of said housing (14) to prevent any waste penetration into said housing (14).

9. The machine of claim 5, wherein a shield skirt (17) is attached to said compacting head (15–16) so as to be tangentially movable with respect to the walls of a receptacle placed inside the tank, and wherein said skirt (17) is completely disengaged from the tank (2–4) when said compacting head (15–16) is in its uppermost position.

10. The machine of claim 5, including detection means located at the same level as said compacting head (15–16), said means consisting of a cam (24) integral with the compacting head an cooperating with a detector (25) to light up a visual indicator when said compacting head exceeds a predeterminated full-tank threshold (B).

11. The machine of claim 10, wherein said full-tank threshold (B) triggers a delay time having a duration longer than the duration of said unclogging operation and at the end of which a bale-end signal is provided if the height has kept exceeding said threshold.

12. The machine of claim 5, wherein the roller turning around its own horizontal longitudinal axis, the double rotation motion of the toothed roller is driven by a single motor (15) wherein the direction of rotation is periodically reversed in normal operation, the period of time between two successive normal inversions being longer than the unclogging operation duration.

13. The machine of claim 12, wherein mechanical coupling means rotatable between the central vertical tank axis and the support arm (13), advantageously are provided to drive the toothed roller (16) for both of its rotation motions, around its own axis and around the tank axis.

14. The machine of claim 5, wherein several supply hoppers 11, distributed around the cylindrical tank are provided to promote a faster execution of the unclogging operation.

15. The method of claim 2, wherein said roller (16) is simultaneously rotatively driven around its own axis and the direction of such rotation is also reversed alter said roller (16) has been raised.

16. The method of claim 1 wherein the roller (16) continues to rotate in the same direction as the roller is lifted to pass over the clog while in contact therewith to spread the material comprising the clog over the waste, the roller reversing direction upon being lowered back toward the waste.

17. The machine of claim 5 wherein the control means includes a timer (43) for delaying stopping rotation of the roller (16) in the initial direction for a selected time interval while the compacting head is being raised before reversing rotation of the roller (16).

* * * * *